United States Patent [19]

Borracci

[11] 4,271,800

[45] Jun. 9, 1981

[54] APPARATUS FOR CHARGING AN INTERNAL COMBUSTION ENGINE

[76] Inventor: Pasquale Borracci, Via Benedetto da Foiano 1, Florence, Italy

[21] Appl. No.: 56,603

[22] Filed: Jul. 11, 1979

[30] Foreign Application Priority Data

Jul. 20, 1978 [IT] Italy ..... 9538 A/78

[51] Int. Cl.[3] ..... F02B 17/00

[52] U.S. Cl. ..... 123/430; 123/274; 123/190 R

[58] Field of Search ..... 123/32 ST, 32 SP, DIG. 4, 123/127, 190 B, 190 R

[56] References Cited

U.S. PATENT DOCUMENTS

| | | | |
|---|---|---|---|
| 1,464,469 | 8/1923 | Douglas | 123/190 R |
| 1,537,748 | 5/1925 | Cole | 123/32 ST |
| 3,948,227 | 4/1976 | Guenther | 123/32 SP |
| 4,036,184 | 7/1977 | Guenther | 123/32 SP |
| 4,147,137 | 4/1979 | Firey | 123/32 ST |

*Primary Examiner*—Charles J. Myhre
*Assistant Examiner*—Andrew M. Dolinar
*Attorney, Agent, or Firm*—Price, Heneveld, Huizenga & Cooper

[57] ABSTRACT

A rotary valve is utilized to accomplish stratified charging of an internal combustion engine. The port in the valve communicates first with a source of non-enriched gases and thereafter with a source of carbureted gases during the intake or suction stroke. The valve is adjustable such that, as engine speed increases, the amount of carbureted gas fed to the combustion chamber is increased.

4 Claims, 6 Drawing Figures

III
III

APPARATUS FOR CHARGING AN INTERNAL COMBUSTION ENGINE

BACKGROUND OF THE INVENTION

This invention relates to the stratified charging of internal combustion engines and, more particularly, to an adjustable rotary valve adapted, depending on engine speed, to feed a predetermined amount of non-carbureted or spent gases into the combustion chamber and, thereafter, a predetermined amount of freshly carbureted gas.

Stratified charging of internal combustion engines is known in the art. This practice, optimally, permits the combustion chamber to be fully pressurized, even at low speeds and, through the use of spent or exhaust gases, can decrease the level of polluting emissions. Stratified charging permits, additionally, the concentration of more highly carbureted gas near the spark plug, typically in a pre-combustion chamber, improving overall engine efficiency.

The present invention provides a novel and highly effective mechanism for accomplishing these functions which is not subject to the disadvantages incurred by existing mechanisms.

SUMMARY OF THE INVENTION

The present invention comprises an apparatus for delivering a charge of relatively non-carbureted and carbureted gases to the combustion chamber of an internal combustion engine. It includes a rotary valve having at least one port therethrough, the port, during rotation of the valve, communicating between the source of non-carbureted gases and a passageway to said combustion chamber and between a source of carbureted gases and said passageway. Means are provided for rotating the valve in timed relation to the engine such that the communication occurs during the intake stroke of the piston occupying the combustion chamber.

DETAILED DESCRIPTION OF THE PREFERRED EMBODIMENT

Figures 1, 2, 3, 4, 5, 6:
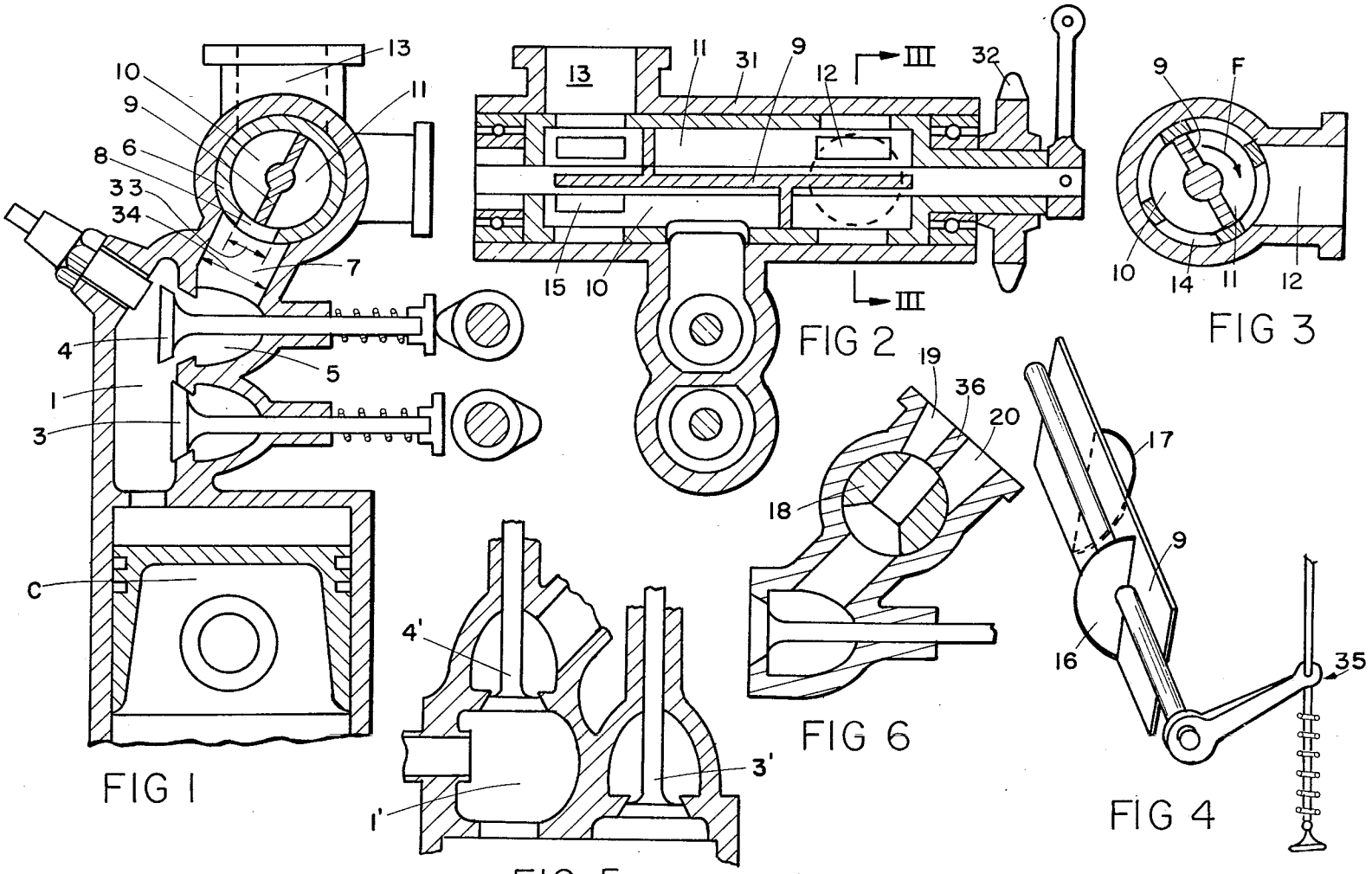
FIG. 1 is a fragmentary, cross section illustrating the apparatus which is the subject of this invention.
FIG. 2 is a fragmentary, longitudinal cross section thereof.
FIG. 3 is a fragmentary, cross section taken along plane III—III of FIG. 2.
FIG. 4 is a perspective view of the diaphragm.
FIG. 5 is a fragmentary, cross section illustrating a differently shaped pre-combustion chamber suitable for utilization in conjunction with the present invention.
FIG. 6 is a fragmentary, cross section illustrating an alternative embodiment of the invention.

The cylinder C (FIG. 1) presents at its top a pre-combustion chamber 1, which may have a scabbard shape, but may be also spheric as indicated at 1' in FIG. 5. The exhaust 3 and suction 4 valves, controlled by the usual system of a cam-shaft, open into the above mentioned pre-combustion chamber (FIG. 1).

The chamber 5 of the suction valve is surmounted by the distributing pipe 6, which introduces the gases into chamber 5. Pipe 6 is rotated within housing 31 by a gear 32 in suitably timed relationship to the opening of suction valve 4. Gear 32, as will be readily apparent to those skilled in the art, may be chain driven from the engine crankshaft.

The upper end of passageway 7 envelops a longitudinal, arcuate section of rotating pipe 6. Pipe 6 contains a slot 8 in its peripheral sidewall. The circumferential width 33 of slot 8 is considerably smaller than the corresponding width 34 of passageway 7. Preferably, as illustrated, slot 8 is about one-half as wide as passageway 7. Gases pass through slot 8 into passageway 7 and thereafter into pre-combustion chamber 1 during the period that suction valve 7 is open. The rotation of pipe 6 is timed such that slot 8 wipes across or traverses passageway 7 when the suction valve is open.

Positioned within pipe 6 and independently rotatable with respect thereto is a diaphragm 9. Diaphragm 9 functions to separate the inert or lesser carbureted gas mixture within pipe 6 from the more highly carbureted mixture. Diaphragm 9, thus, separates hemi-cylinder 10, containing the pure air, burnt gases or lesser carbureted gases from the hemi-cylinder 11, which contains the more highly carbureted gas.

The angular position of diaphragm 9 within pipe 6 is adjustable and may be driven directly by the accelerator pedal through link 35. Specifically, as the accelerator pedal is depressed, the diaphragm rotates angularly in the direction of arrow F in FIG. 3, thus increasing the time period slot 8 is in communication with hemi-cylinder 11 containing the more highly carbureted gas relative to the time it is in communication with hemi-cylinder 10. The diametrical edges of diaphragm 9 may clear the smooth interior diameter of pipe 6 by a few thousandths of an inch without significant leakage problems.

Carbureted gas is supplied to hemi-cylinder 11 as shown in FIG. 3. The gas coming from the carburetor arrives through the pipe 12 to the chamber enclosing for a certain angle the pipe 6. This pipe has, in the area of the pipe 12, a set of slits 14, which allow the entering of the gas in the chamber 11 of the rotating pipe. In the part opposite to the inlet 12, there is the pipe 13 (FIG. 2), which brings the pure air or the mixture of air and burnt gases, to the area 10 of the pipe 6, through the slits 15 in similar fashion. In order to avoid leakage of the gases from the ends of the chamber 11, the diaphragm 9 (FIG. 3) has two semi-circular walls 16 and 17 (FIG. 3) at its ends (right and left).

FIGS. 1, 2, 3 and 4 show one of the solutions for the laying of the mixture to be applied to the inlet chamber of the suction valve of the engines with Otto-cycle. However, the use of a rotating distributor with a first stage of introduction of inert gases (air or burnt gas) can be accomplished by other means.

For instance, FIG. 6 shows a rotating distributor 18, crossed by a channel, which receives successively the inert gas of the duct 19 and then the carbureted gas of the duct 20. The different fractionations, or ratios, between inert gas (air or air and burnt gases mixture) and carbureted mixture can be obtained by modifying in any way the cycles or speed of the rotor 18 in respect to the opening angles of the suction valve or mechanically changing the position of partition 36.

Since the driving device of the engine power is centralized in the rotating distributor, which regulates the percents of pure air (or mixed to burned gas) and of the carbureted air, the carbureted air can be supplied by a rough carburetor, without throttle. Of course, the air and the carbureted mixture can be heated by using the exhaust gases to improve the thermo-dynamic efficiency of the motor.

Another significant feature of the system which is the subject of this invention is that, at maximum power, air with the optimum percent of fuel is introduced into the engine, while at lower power, the otherwise noxious emissions can be completely or almost completely burned. Power delivery is not subject to sharp reductions at higher speeds as is the case in most modern, pollution controlled engines.

When the engine is running at low speeds, the vehicle is usually in a highly populated area and, by using the present invention of feeding the exhaust gases back into the combustion chamber, noxious emissions are effectively controlled. When, on the other hand, the engine is running at high speeds, the noxious gases to the extent produced are primarily vented to the atmosphere and, since the vehicle during these periods is usually on a highway or in the country, they are of little importance.

Significant, additionally, is the fact that fuel introduction can be closely keyed to engine speed. This permits obtaining maximum power at any given fuel consumption rate.

The gases fed into hemi-cylinder 10, as noted, may be plain air or exhaust gases. It may be desirable, in some situations, to carburete the same to some extent. The terms "carbureted" and "non-carbureted" as utilized in this specification and the accompanying claims, thus, are intended to be relative and do not exclude the presence of some fuel in the non-carbureted gases.

While a preferred embodiment of this invention and a modification thereof have been described in detail, it will be readily apparent to those skilled in the art that other embodiments can be conceived and fabricated without departing from the spirit and scope of this specification and the accompanying drawings. Such other embodiments are to be deemed included within the scope of the appended claims unless these claims, by specific language, expressly state otherwise.

The embodiments of the invention in which an exclusive property or privilege is claimed are defined as follows:

1. Apparatus for delivering a charge of relatively non-carbureted and carbureted gases to the combustion chamber of an internal combustion engine, said chamber having a movable piston in association therewith, said piston defining during a phase of its movement an intake stroke for said chamber, said apparatus comprising:

a rotary valve having at least one port therethrough, said port, during rotation of said valve, communicating between a source of non-carbureted gases and a passageway to said combustion chamber and between a source of carbureted gases and said passageway, said rotary valve including:

a rotatable, hollow cylinder having a first port through the sidewall thereof which passes into communication with said combustion chamber during rotation of said cylinder;

a generally stationary diaphragm positioned within said cylinder, said diaphragm dividing the interior of said cylinder longitudinally into a non-carbureted gas chamber and a carbureted gas chamber, the rotational position of said diaphragm being such that one edge thereof overlies said passageway;

means for supplying non-carbureted gases to said non-carbureted gas chamber;

means for supplying carbureted gases to said carbureted gas chamber; and means for rotating said valve in timed relation to said engine such that such communication occurs during the intake stroke of the piston associated with said combustion chamber.

2. Apparatus as set forth in claim 1 which further comprises means for varying the relative amounts of noncarbureted and carbureted gases delivered to said combustion chamber through said passageway during said intake stroke.

3. Apparatus as set forth in claim 1 further comprising means for shifting the rotational position of said diaphragm within said cylinder to control the relative amounts of non-carbureted and carbureted gases passed into said combustion chamber during said intake stroke.

4. Apparatus as set forth in claim 3 wherein said engine includes an accelerator and wherein said shifting means includes said accelerator, said accelerator being linked to said diaphragm such that, as said accelerator is depressed, said diaphragm rotates to lessen the time period during said intake stroke that said passageway is in communication with said non-carbureted gas chamber and lengthen the time said passageway is in communication with said carbureted gas chamber.

* * * * *